US006395696B2

(12) United States Patent
Finch et al.

(10) Patent No.: US 6,395,696 B2
(45) Date of Patent: May 28, 2002

(54) DETERGENT COMPOSITIONS CONTAINING A CATIONIC DETERGENT AND BUILDER

(75) Inventors: Timothy David Finch; Amrat Paul Singh, both of Bebington (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/872,879

(22) Filed: Jun. 1, 2001

(30) Foreign Application Priority Data

Jun. 2, 2000 (GB) ..... 0013501

(51) Int. Cl.[7] ..... C11D 1/62; C11D 3/30

(52) U.S. Cl. ..... 510/330; 510/276; 510/308; 510/329; 510/480; 510/504

(58) Field of Search ..... 510/276, 308, 510/329, 330, 480, 504

(56) References Cited

U.S. PATENT DOCUMENTS

| | | | | |
|---|---|---|---|---|
| 3,697,453 A | | 10/1972 | Tate et al. | 252/546 |
| 5,174,927 A | * | 12/1992 | Honsa | 252/543 |
| 5,318,726 A | | 6/1994 | Rossmaier et al. | 252/546 |
| 5,780,419 A | * | 7/1998 | Doumen et al. | 510/452 |
| 5,977,053 A | | 11/1999 | Groth et al. | 510/480 |
| 6,087,314 A | * | 7/2000 | Heinzman et al. | 510/352 |
| 6,096,097 A | * | 8/2000 | Kummeler et al. | 8/111 |
| 6,242,402 B1 | * | 6/2001 | Robbins et al. | 510/238 |

FOREIGN PATENT DOCUMENTS

| | | |
|---|---|---|
| DE | 43 11 440 | 10/1994 |
| EP | 225 A | 1/1979 |
| EP | 234 A | 1/1979 |
| EP | 235 A | 1/1979 |
| EP | 51896 B | 5/1982 |
| EP | 0 513 948 A2 | 11/1992 |
| EP | 0 678 572 A1 | 10/1995 |
| EP | 509 382 | 11/1998 |
| JP | 08 041490 A | 2/1996 |
| JP | 09 104897 | 4/1997 |
| JP | 09 110 813 | 4/1997 |
| JP | 09 249895 | 9/1997 |
| JP | 09 100497 | 12/1997 |
| JP | 09 310097 | 12/1997 |
| WO | 00/34427 | 6/2000 |
| WO | 01/46371 A1 | 6/2001 |
| WO | 01/444428 A1 | 6/2001 |

OTHER PUBLICATIONS

GB Search Report in a GB application GB 0013501.2, Dec. 15, 2000.

Co–pending Application: Ebbrell et al., S/N: 09/456,808, Filed: Dec. 8, 1999.

Derwent Abstract PN JP09279188—1 page, Oct. 28, 1997.

* cited by examiner

*Primary Examiner*—Charles Boyer

(74) *Attorney, Agent, or Firm*—Alan A. Bornstein

(57) ABSTRACT

A built laundry detergent composition containing cationic detergent surfactant also contains from 0.05 to 5 wt % of iminodisuccinate (IDS) or hydroxyiminodisuccinate (HIDS). The composition provides improved moil and stain removal in conjunction with reduced dye fading of coloured fabrics.

14 Claims, No Drawings

DETERGENT COMPOSITIONS CONTAINING A CATIONIC DETERGENT AND BUILDER

TECHNICAL FIELD

The present invention relates to laundry detergent compositions suitable for washing both white and coloured fabrics. The compositions of the invention contain cationic detergent surfactant and also contain a specific sequestrant, iminodisuccinate or hydroxyiminodisuccinate.

BACKGROUND AND PRIOR ART

Laundry detergent compositions containing cationic surfactants in combination with anionic and/or nonionic. surfactants are disclosed in many published documents, for example, EP 225A, EP 234A, EP 235A and EP 51 896B (Procter & Gamble).

Iminodisuccinate (IDS) is known as a detergency builder and, in bleaching detergent compositions, as a stabiliser for peroxy bleach precursors.

U.S. Pat. No. 3,697,453 (Pfizer) discloses detergent compositions having a pH of from 9 to 12, containing iminodisuccinate as a detergency builder, used together with detergent surfactant in a weight ratio of 0.25:1 to 10:1. IDS as a detergency builder is also disclosed in EP 757 094A (Bayer). IDS and hydroxyiminodisuccinate (HIDS) are disclosed in JP 09 110 813A (Nippon Shokubai) and JP 09 104 897A (Nippon Shokubai). HIDS as a detergency builder and complexing agent is disclosed in U.S. Pat. No. 5,318,726 (Henkel KGaA). EP 509 382A (W R Grace & Co/Hampshire Chemical Corporation) discloses a bleaching detergent composition comprising a bleaching agent and a bleach stabilizer of defined formula which includes IDS.

JP 09 249 895A (Lion) and JP 09 310 097A (Lion) disclose detergent compositions containing 3 to 20 wt % IDS or HIDS to improve the stability or fabric substantivity of fluoreacers (optical brighteners).

The use of IDS as a processing aid for detergent powders and detergent powder ingredients is disclosed in JP 09 100 497A (Lion) and JP 09 279 188A (Lion).

It has now been found that detergent compositions containing cationic detergent surfactant and low levels of IDS or HIDS exhibit improved soil and stain removal in conjunction with reduced fading of dyes on coloured fabrics.

DEFINITION OF THE INVENTION

The present invention accordingly provides a laundry detergent composition comprising surfactant, builder, and optionally other detergent ingredients, the composition comprising (a) from 0.1 to 10 wt % of a cationic detergent surfactant, and (b) from 0.05 to 5 wt % of a compound of the formula I:

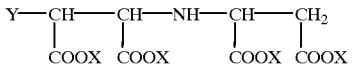

(I)

wherein Y is H or OH, and X is H or a solubilising cation, the ratio of cationic detergent surfactant to compound of the formula I being within the range of from 1:5 to 5:1.

A further subject of the invention is a method of removing soils and stains from textile fabrics, which comprises laundering the fabrics by hand or machine in a wash liquor containing a detergent composition as defined above.

A further subject of the invention is the use of the compound of the formula I above in an amount of 0.05 to 2.5 wt % to improve the soil and stain removal performance of a laundry detergent composition containing from 0.5 to 10 wt % of a cationic detergent surfactant.

DETAILED DESCRIPTION OF THE INVENTION

The Compound of Formula I

The detergent compositions of the invention-contain, as an essential ingredient, a compound of the formula I:

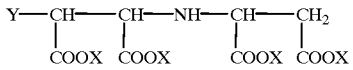

(I)

wherein Y is H or OH, preferably H; and X is H or a solubilising cation, preferably a sodium ion.

If Y is a hydrogen atom, the formula I represents iminodisuccinic acid or a water-soluble salt thereof. Iminodisuccinic acid, also known as N-(1,2-carboxyethyl)D,L-aspartic acid, has the formula (Ia) wherein X=H:

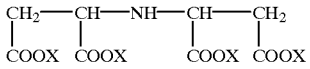

(Ia)

In the following description, the abbreviation "IDS" will be used to denote this material whether in acid or salt form. IDS is commercially available from Bayer AG, Leverkusen, Germany, and from Nippon Shokubai KK, Japan.

If Y is a hydroxyl group, the formula I represents hydroxyiminodisuccinic acid or a water-soluble salt thereof.

Hydroxyiminodisuccinic acid has the formula (Ib) wherein X=H:

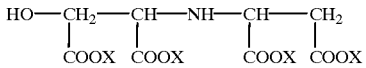

(Ib)

In the following description, the abbreviation "HIDS" will be used to denote this material whether in acid or salt form. HIDS is commercially available from Nippon Shokubai KK, Japan.

For the purposes of the present invention, the IDS or HIDS may be, and preferably is, in the form of a salt, i.e. X in the formula I is a stable solubilising cation, preferably an alkali metal cation, more preferably sodium.

In the laundry detergent compositions of the invention, IDS or HIDS is present in an amount of from 0.05 to 5 wt %, preferably from 0.2 to 2.5 wt %, more preferably from 0.5 to 1.5 wt %, and most preferably from 0.5 to 1.0 wt %.

The IDS or HIDS is preferably in sodium salt form.

The Cationic Detergent Surfactant

Cationic surfactants that may be used include linear or cyclic quaternary ammonium salts.

One class of preferred materials has the general formula II:

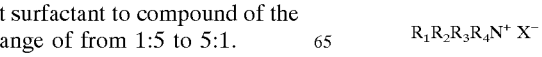

$R_1R_2R_3R_4N^+ X^-$ wherein the R groups are long or short hydrocarbyl chains, typically alkyl, hydroxyalkyl or ethoxylated alkyl groups, and X is a solubilising anion, for example, a halide or methosulphate ion.

Preferred compounds are those in which $R_1$ is a $C_8$–$C_{22}$ alkyl group, more preferably a $C_8$–$C_{10}$ or $C_{12}$–$C_{14}$ alkyl group; $R_2$ is a methyl group; and $R_3$ and $R_4$, which may be the same or different, are methyl or hydroxyethyl groups.

In an especially preferred compound, $R_1$ is a $C_{12}$–$C_{14}$ alkyl group, $R_2$ and $R_3$ are methyl groups, $R_4$ is a 2-hydroxyethyl group, and $X^-$ is a chloride ion. This material in available commercially from Clariant GmbH as Praepagen (Trade Mark) HY.

Other cationic surfactants of interest include cocotrimethyl ammonium chloride, coco methyl dihydroxyethyl chloride, and cationic eaters (for example, choline esters).

The cationic surfactant is present in an amount of from 0.1 to 10 wt %, preferably from 0.2 to 5 wt %, more preferably front 0.5 to 3 wt %.

Detergent Compositions

The composition of the invention also contains other conventional detergent ingredients, other than bleaching ingredients. Essential ingredients are surfactants (detergent-active compounds) and detergency builders, and other ingredients may optionally be present.

A preferred detergent composition according to the invention comprises:

(a) from 5 to 40 wt % of one or more detergent surfactants selected from anionic, nonionic, amphoteric and zwitterionic surfactants, (b) from 0.1 to 10 wt % of cationic detergent surfactant, (c) from 10 to 80 wt % of one or more detergency builders, (d) from 0.05 to 5 wt % of IDS or HIDS, (e) optionally other detergent ingredients to 100 wt %, the ratio of (b) to (d) being within the range of from 1:5 to 5:1 (0.2:1–5:1)

The ratio of cationic surfactant to IDS or RIDS in preferably from 0.5:1 to 5:1, more preferably 1:1 to 5:1.

The detergent compositions of the invention may be of any physical form.

Surfactants (Detergent-Active Compounds)

In addition to the cationic surfactant which is an essential feature of the invention, which is present in a relatively minor amount, the detergent compositions will contain one more other detergent surfactants which may be chosen from soap and non-soap anionic, nonionic, amphoteric and zwitterionic surfactants, and mixtures thereof.

Many suitable detergent active compounds are available and are fully described in the literature, for example, in "Surface-Active Agents and Detergents", Volumes I and II, by Schwartz, Perry and Berch.

The preferred detergent active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphate; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Amphoteric surfactants, for example, amine oxides, and zwitterionic surfactants, for example, betaines, may also be present.

Preferably, the quantity of anionic surfactant is in the range of from 5 to 50% by weight of the total composition. More preferably, the quantity of anionic surfactant is in the range of from 8 to 35% by weight.

Nonionic surfactant, if present, is preferably used in an amount within the range of from 1 to 20% by weight.

The total amount of surfactant present is preferably within the range of from 5 to 60 wt %.

Detergency Builders

The compositions may suitably contain from 10 to 80%, preferably from 15 to 70% by weight, of detergency builder. Preferably, the quantity of builder is in the range of from 15 to 50% by weight.

The detergent compositions may contain as builder a crystalline aluminosilicate, preferably an alkali metal aluminosilicate, more preferably a sodium aluminosilicate (zeolite).

The zeolite used as a builder may be the commercially available zeolite A (zeolite 4A) now widely used in laundry detergent powders. Alternatively, the zeolite may be maximum aluminium zeolite P (zeolite Em as described and claimed in EP 384 070B (Unilever), and commercially available as Doucil (Trade Mark) A24 from Crosfield Chemicals Ltd, UK. Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20.

Especially preferred is zeolite MAP having a silicon to aluminium ratio not exceeding 1.07, more preferably about 1.00. The particle size of the zeolite is not critical, Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Organic builders that may be present include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxymethyloxymalonates, dipicolinates, hydroxyethyliminodiacetates, alkyl- and alkenylmalonates and succinates, and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Other Ingredients

Detergent compositions according to the invention may also suitably contain a bleach system. This preferably comprises a peroxy bleach compound, for example, an inorganic persalt or an organic peroxyacid, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED). The novel quaternary ammonium and phosphonium bleach precursors disclosed in U.S. Pat. No. 4,751,015 and U.S. Pat. No. 4,818,426 (Lever Brothers Company) and EP 402 971A (Unilever) are also of great interest. Especially preferred are peroxycarbonic acid precursors, in particular cholyl-4-sulphophenyl carbonate. Also of interest are peroxybenzoic acid precursors, in particular, N,N,N-trimethylammonium toluoyloxy benzene sulphonate; and the cationic bleach precursors disclosed in EP 284 292A and EP 303 520A (Kao).

A bleach stabilizer (heavy metal sequestrant) may also be present. Suitable bleach stabilizers include ethylenediamine tetraacetate (EDTA) and the polyphosphonates such as Dequest (Trade Mark), EDTMP.

The detergent compositions may also contain one or more enzymes. Suitable enzymes include the proteases, amylases, callulazes, oxidases, peroxidases and lipases usable for incorporation in detergent compositions.

Preferred proteolytic enzymes (proteases) are catalytically active protein materials which degrade or alter protein types of stains when present as in fabric stains in a hydrolysis reaction. They may be of any suitable origin, such as vegetable, animal, bacterial or yeast origin. Proteolytic enzymes or proteases of various qualities and origins and having activity in various pH ranges of from 4–12 are available. Proteases of both high and low isoelectric point are suitable.

Other enzymes that may suitably be present include lipases, amylases, and cellulases including high-activity cellulases such as "Carezyme").

In particulate detergent compositions, detergency enzymes are commonly employed in granular form in amounts of from about 0.1 to about 3.0 wt %. However, any suitable physical form of enzyme may be used in any effective amount.

Antiredeposition agents, for example cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22.

Especially preferred soil release polymers are the sulphonated non-end-capped polyesters described and claimed in WO 95 32997A (Rhodia Chimie).

Other ingredients that may be present include solvents, hydrotropes, fluorescers, photobleaches, foam boosters or foam controllers (antifoams) am appropriate, sodium carbonate, sodium bicarbonate, sodium silicate, sodium sulphate, calcium chloride, other inorganic salts, fabric conditioning compounds, and perfumes.

Product Form

An previously indicated, the compositions of the invention may be of any suitable physical form, for example, particulates (powders, granules, tablets), liquids, pastes, gels or bars.

According to one especially preferred embodiment of the invention, the detergent composition is in particulate form.

If necessary, the IDS may be incorporated in particulate compositions in the form of granules containing an inert carrier material.

Compositions in powder form may be of any bulk density and may be prepared by spray-drying, non-tower granulation, or any combination of these techniques.

According to another especially preferred embodiment of the invention, the detergent composition is in liquid form.

Liquid detergent compositions may be prepared by admixing the essential and optional ingredients in any desired order to provide compositions containing the ingredients in the requisite concentrations.

EXAMPLES

The invention will now be illustrated in further detail by means of the following Examples, in which parts and percentages are by weight unless otherwise stated. Examples designated with a number illustrate the invention, while examples designated with a letter are comparative.

Example 1, Comparative Examples A To C

Detergent compositions were prepared to the formulations shown in the table below. The cationic surfactant was Praepagen (Trade Mark) HY ex Clariant.

| | A | B | C | 1 |
|---|---|---|---|---|
| Sodium linear alkylbenzene sulphonate (NaLAS) | 24.0 | 21.6 | 24.0 | 21.6 |
| Cationic surfactant | — | 2.4 | — | 2.4 |
| Sodium tripolyphosphate | 15.0 | 15.0 | 15.0 | 15.0 |
| Sodium carbonate | 15.6 | 15.6 | 15.6 | 15.6 |
| Sodium sulphate | 18.3 | 18.3 | 18.3 | 18.3 |
| Sodium silicate | 6.7 | 6.7 | 6.7 | 6.7 |
| Sodium iminodisuccinate | — | — | 0.625 | 0.625 |
| Water and minors | to 100% | | | |

The formulations were used to wash polyviscose test cloths stained with a red mud/Vaseline stain in a tergotometer test under the following conditions:

| | |
|---|---|
| Product concentration | 2 g/l |
| Water hardness | 6° FH |
| Liquor to cloth ratio | 30:1 |
| Wash temperature | 25° C. |
| Wash time | 10 mins soak, 15 mins wash at 90 rpm |
| Rinses | x1 at 30:1 liquor to cloth ratio |

The table below shows the amount of residual stain remaining on the fabrics, as a ΔE (reflectance change) value indicative of total colour change across the whole visible spectrum: the lower the ΔE value, the greater the stain removal.

| Example | Amounts (wt %) of variable components | | | Residual stain |
|---|---|---|---|---|
| | LAS | Cationic Surfactant | IDS | remaining on fabric (ΔE) |
| A | 24.0 | 0.0 | 0.0 | 9.6 |
| B | 21.6 | 2.4 | 0.0 | 8.9 |
| C | 24.0 | 0.0 | 0.625 | 9.16 |
| 1 | 21.6 | 2.4 | 0.625 | 8.42 |

Examples 2 to 5

Low-Foaming Powder Formulations for Use in Drum-Type Automatic Washing Machines

| Ingredient | 2 | 3 | 4 | 5 |
|---|---|---|---|---|
| LAS | 5.8 | 5.4 | 8.8 | 7.8 |
| Nonionic 7EO | 3.4 | 3.4 | — | — |
| Cationic | 0.6 | 1.0 | 1.0 | 2.0 |
| STP[1] | | 25.0 | | |
| Na carbonate | | 6.3 | | |
| Na sulphate | | 23.0 | | |
| Na silicate | | 9.0 | | |
| Soil release polymer | | 0.7 | | |
| Na perborate | | 5.84 | | |
| TAED[2] | | 2.28 | | |
| Enzymes[3] | | 1.32 | | |
| Antifoam granules | | 2.0 | | |
| IDS | | 0.5–1.25 | | |
| Water + minors | | to 100 | | |

[1]Sodium tripolyphosphate
[2]Tetracetylethylenediamine
[3]Protease, lipase, amylase

Examples 6 to 9

Powder Formulations Suitable for Both Top-Loading and Drum-Type Washing Machines

| Ingredient | 6 | 7 | 8 | 9 |
|---|---|---|---|---|
| LAS | 10.5 | 10.0 | 9.5 | 9.0 |
| Nonionic 7EO | 5.0 | 5.0 | 5.0 | 5.0 |
| Cationic | 0.5 | 1.0 | 1.5 | 2.0 |
| STP | | 34.0 | | |
| Na carbonate | | 3.7 | | |
| Na silicate | | 7.0 | | |
| SCMC[1] | | 0.5 | | |
| Soil release polymer | | 0.35 | | |
| Na perborate | | 7.7 | | |
| TAED[2] | | 2.2 | | |
| Enzymes[3] | | 1.79 | | |
| Fluorescer | | 0.15 | | |
| IDS | | 0.5–1.25 | | |
| Water + minors | | to 100 | | |

[1]Sodium carboxymethyl cellulose
[2]Tetracetylethylenediamine
[3]Protease, lipase, amylase, cellulase

Examples 10 to 13

Powder Formulations Suitable for Both Top-Loading Machine Use and Handwash Use

| Ingredient | 10 | 11 | 12 | 13 |
|---|---|---|---|---|
| LAS | 23.0 | 22.0 | 21.0 | 20.0 |
| Cationic | 1.0 | 2.0 | 2.0 | 3.0 |
| STP | | 19.0 | | |
| Na carbonate | | 15.0 | | |
| Na sulphate | | 14.0 | | |
| Na silicate | | 7.0 | | |
| SCMC[1] | | 0.37 | | |
| Acrylate/maleate copolymer | | 1.5 | | |
| Na perborate | | 8.0 | | |
| TAED[2] | | 2.4 | | |
| Enzymes[3] | | 1.7 | | |
| Fluorescer | | 0.19 | | |
| IDS | | 0.5–1.25 | | |
| Water + minors | | to 100 | | |

[1]Sodium carboxymethyl cellulose
[2]Tetracetylethylenediamine
[3]Protease, lipase, amylase

Examples 14 to 22

Further Examples of Particulate Laundry Detergent Compositions in Accordance with the Invention

| | 14 | 15 |
|---|---|---|
| Sodium linear alkylbenzene sulphonate (NaLAS) | 20–25 | 20–25 |
| Cationic surfactant | 0.2–5.0 | 0.2–5.0 |
| Sodium silicate (anhydrous) | 7.37 | 4.67 |
| Sodium tripolyphosphate | 18.77 | 18.67 |
| Sodium carbonate | 7.00 | |
| Sodium carboxymethyl cellulose | 0.52 | 0.25 |
| Polyacrylate polymer | 0.54 | 0.70 |
| Calcite | 9.88 | 10.00 |
| IDS | 0.5–1.25 | 0.5–1.25 |
| Sodium sulphate, water, impurities | to 100 | to 100 |

| | 16 | 17 | 18 | 19 |
|---|---|---|---|---|
| NaLAS | 10.00 | 22.00 | 28.00 | 15.00 |
| NaPAS | 15.00 | | | |
| Nonionic $C_{12-15}$ 7EO | | | | 1.00 |
| Cationic surfactant | 0.8–1.0 | 0.8–1.0 | 0.8–1.0 | 0.8–1.0 |
| Na silicate (anhydr) | | 6.00 | 8.00 | 15.00 |
| Na sulphate | 19.29 | 37.90 | 15.16 | 23.90 |
| Na tripolyphosphate | 30.00 | 20.00 | 23.49 | |
| SCMC | 0.75 | 0.70 | 0.65 | 0.40 |
| Acrylate/maleate copolymer | 0.50 | | 0.50 | |
| Calcite | 10.00 | | 3.64 | |
| Zeolite (78%) | | | | 20.00 |
| Citric acid | | 1.50 | | |
| Na carbonate | | 1.00 | | |
| Na bicarbonate | | | 10.00 | 16.00 |
| Enzymes | 0.53 | 0.97 | 0.68 | 0.25 |
| IDS | 0.5–1.25 | 0.5–1.25 | 0.5–1.25 | 0.5–1.25 |
| Water, impurities | to 100 | to 100 | to 100 | to 100 |

| | 20 | 21 | 22 |
|---|---|---|---|
| NaLAS | 22.92 | 20.00 | 16.80 |
| Nonionic $C_{12-15}$ 7EO | | | 2.50 |
| Cationic surfactant | 0.8–1.0 | 0.8–1.0 | 0.8–1.0 |
| Na silicate (anhydr) | 5.36 | 12.00 | 8.22 |
| Na sulphate | 28.71 | 39.12 | 20.17 |
| Na tripolyphosphate | 18.67 | 12.00 | 24.00 |
| SCMC | 0.25 | 0.50 | 1.00 |
| Acrylate/maleate copolymer | 0.70 | 0.50 | 0.50 |
| Calcite | 10.00 | | |
| Zeolite (anhydr) | 1.56 | | |
| Zeolite (78%) | | | 4.93 |
| Na carbonate | | 8.00 | 15.00 |
| Enzymes | 0.16 | 0.51 | 0.56 |
| IDS | 0.6–1.25 | 0.6–1.25 | 0.6–1.25 |
| Water, impurities | to 100 | to 100 | to 100 |

Examples 23 to 25

Concentrated (High Bulk Density) Detergent compositions Containing Cationic Surfactant And IDS

| | 23 | 24 | 25 |
|---|---|---|---|
| NaLAS | 15.63 | 22.82 | 18.00 |
| Nonionic $C_{12-15}$ 7EO | 7.00 | | 3.25 |
| Cationic | 0.8–1.0 | 0.8–1.0 | 0.8–1.0 |
| Na sulphate | | | 1.30 |
| Na tripolyphosphate | | 30.57 | |
| SCMC | 0.60 | 0.77 | 1.00 |
| Acrylate/maleate copolymer | | 1.96 | 2.00 |
| Zeolite (78%) | 44.65 | 23.13 | 50.00 |
| Na carbonate | 12.12 | 6.73 | 19.00 |
| Na bicarbonate | 17.77 | 5.87 | |
| Enzymes | 2.00 | 0.51 | 0.45 |
| IDS | 1.25 | 1.25 | 1.25 |
| Fluorescer, perfume, speckles, water | to 100 | to 100 | to 100 |

We claim:

1. A laundry detergent composition comprising surfactant, builder, and optionally other detergent ingredients, the composition comprising (a) from 0.1 to 10 wt % of a cationic detergent surfactant, and (b) from 0.05 to 5 wt % of a compound of the formula I;

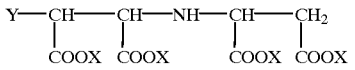

(I)

wherein Y is H or OH, and X is H or a solubilising cation, the ratio of cationic detergent surfactant to compound of the formula I being within the range of from 1:5 to 5:1.

2. A detergent composition as claimed in claim 1, wherein the ration of cationic detergent surfactant to compound of the formula I is within the range of from 0.5:1 to 5:1.

3. A detergent composition as claimed in claim 1, which comprises:

(a) from 5 to 40 wt % of one or more detergent surfactants selected from anionic, nonionic, amphoteric and zwitterionic surfactants, (b) from 0.1 to 10 wt % of cationic detergent surfactant, (c) from 10 to 80 wt % of one or more detergency builders, and;

(d) from 0.05 to 5 wt % of a compound of the formula I.

4. A detergent composition as claimed in claim 1, which comprises from 0.2 to 2.5 wt % of the compound of the formula I.

5. A detergent composition as claimed in claim 1, wherein the compound of the formula I is iminodisuccinic acid or a salt thereof.

6. A detergent composition as claimed in claim 1, which comprises from 0.5 to 5 wt % of the cationic detergent surfactant.

7. A detergent composition as claimed in claim 1, wherein the cationic detergent surfactant is a quaternary ammonium compound of the formula II $$R_1R_2R_3R_4N^+ X^- \quad \text{(II)}$$

wherein $R_1$ is a $C_8$–$C_{22}$ alkyl group; $R_2$ is a methyl group; and $R_3$ and $R_4$, which may be the same or different, are methyl or hydroxyethyl groups; and $X^-$ is a solubilising anion.

8. A detergent composition as claimed in claim 7, wherein the cationic detergent surfactant is a compound of the formula II in which $R_1$ is a $C_{12}$–$C_{14}$ alkyl group, $R_2$ and $R_3$ are methyl groups, $R_4$ is a 2-hydroxyethyl group, and $X^-$ in a chloride ion.

9. A detergent composition as claimed in claim 1, which is in particulate form.

10. A detergent composition as claimed in claim 1, which comprises one or more detergent ingredients selected from bleaches, bleach activators, bleach stabilisers, enzymes, antiredeposition polymers, soil release polymers, dye transfer inhibiting polymers, solvents, hydrotropes, fluorescers, photobleaches, foam boosters, foam controllers (antifoams), sodium carbonate, sodium bicarbonate, sodium silicate, sodium sulphate, calcium chloride, other inorganic salts, fabric conditioning compounds, and perfumes.

11. A method of removing soils and stains from textile fabrics, which comprises laundering the fabrics by hand or machine in a wash liquor containing a detergent composition as claimed in claim 1.

12. A detergent composition as claimed in claim 1, wherein the ratio of cationic detergent surfactant to compound of the formula I is within the range from 1:1 to 5:1.

13. A detergent composition as claimed in claim 1, which comprises from 0.5 to 1.5 wt %, of the compound of the formula I.

14. A detergent composition as claimed in claim 1, wherein the compound of formula I is iminodisuccinic acid, sodium salt.

* * * * *

UNITED STATES PATENT AND TRADEMARK OFFICE

CERTIFICATE OF CORRECTION

PATENT NO. : 6,395,696 B2
DATED : May 28, 2002
INVENTOR(S) : Finch et al.

It is certified that error appears in the above-identified patent and that said Letters Patent is hereby corrected as shown below:

Title page,
Item [57], ABSTRACT,
Line 4, which reads "(HIDS). The composition provides improved moil and stain" should read -- (HIDS). The composition provides improved soil and stain --

Column 1,
Line 15, which reads "...factants in combination with anionic and/or nonionic.sur-…" should read -- ...factants in combination with anionic and/or nonionic sur-… --
Line 39, which reads "fluoreacers (optical brighteners)." should read -- fluorescers (optical brighteners). --

Column 2,
Line 11, which reads "The detergent compositions of the invention-contain, as" should read -- The detergent compositions of the invention contain, as --

Column 3,
Line 10, which reads "...rial in available commercially from Clariant GmbH as" should read -- ...rial is available commercially from Clariant GmbH as --
Line 17, which reads "front 0.5 to 3 wt %." should read -- from 0.5 to 3 wt %. --.
Line 37, which reads "The ratio of cationic surfactant to IDS or RIDS in pref-" should read -- The ratio of cationic surfactant to IDS or HIDS is pref- --

Column 6,
Line 3, which reads "foam controllers (antifoams) am appropriate, sodium" should read -- foam controllers (antifoams) as appropriate, sodium --
Line 8, which reads "An previously indicated, the compositions of the inven-" should read -- As previously indicated, the compositions of the inven- --

UNITED STATES PATENT AND TRADEMARK OFFICE

CERTIFICATE OF CORRECTION

PATENT NO. : 6,395,696 B2
DATED : May 28, 2002
INVENTOR(S) : Finch et al.

It is certified that error appears in the above-identified patent and that said Letters Patent is hereby corrected as shown below:

Column 9,
Line 59, which reads "the ration of the cationic detergent surfactant to compound of" should read -- the ratio of cationic detergent surfactant to compound of --

Signed and Sealed this

Eleventh Day of March, 2003

JAMES E. ROGAN
*Director of the United States Patent and Trademark Office*